United States Patent [19]

Sano et al.

[11] Patent Number: 4,953,486

[45] Date of Patent: Sep. 4, 1990

[54] ELECTRONIC ZIGZAG SEWING MACHINE

[76] Inventors: Yasuro Sano, 1601-2, Narahara-cho; Akira Orii, 432, Terada-cho; Eiji Murakami, 682-1, Izumi-cho, all of Hachioji, Tokyo, Japan

[21] Appl. No.: 261,879

[22] Filed: Oct. 24, 1988

[30] Foreign Application Priority Data

Oct. 23, 1987 [JP] Japan ..... 62-266205

[51] Int. Cl.[5] ..... D05B 3/06

[52] U.S. Cl. ..... 112/447; 112/235

[58] Field of Search ..... 112/447, 264.1, 65, 112/77, 235

[56] References Cited

U.S. PATENT DOCUMENTS 4,216,732 8/1980 Marsh et al. ..... 112/447

4,409,913 10/1983 Adams et al. ..... 112/447

4,502,401 3/1985 Asai et al. ..... 112/264.1 X

*Primary Examiner*—Peter Nerbun

*Attorney, Agent, or Firm*—Klein & Vibber

[57] ABSTRACT

Disclosed is an electronic zigzag sewing machine adapted to produce one or more of buttonhole stitch patterns, including several parts to be sequentially stitched, in response to stitch control data stored in a memory unit. The sewing machine includes a vertically extending presser bar, to the lower end of which there is detachably mounted a presser foot for exerting a downwardly directing pressure onto a workpiece. The presser foot is provided with a photo-sensor capable of detecting a longitudinal end of a buttonhole during stitching operation of the buttonhole stitch pattern; a step-up timing, at which one part of the buttonhole stitch pattern proceeds to the next part, can be automatically detected so that the buttonhole stitch pattern can be produced step by step without necessity of manual operation. With another presser foot provided with no photo-sensor means, the operator manipulates a key button when visually determining the step-up timing, in response to which the one part of the buttonhole is likewise renewed to the next part.

3 Claims, 5 Drawing Sheets

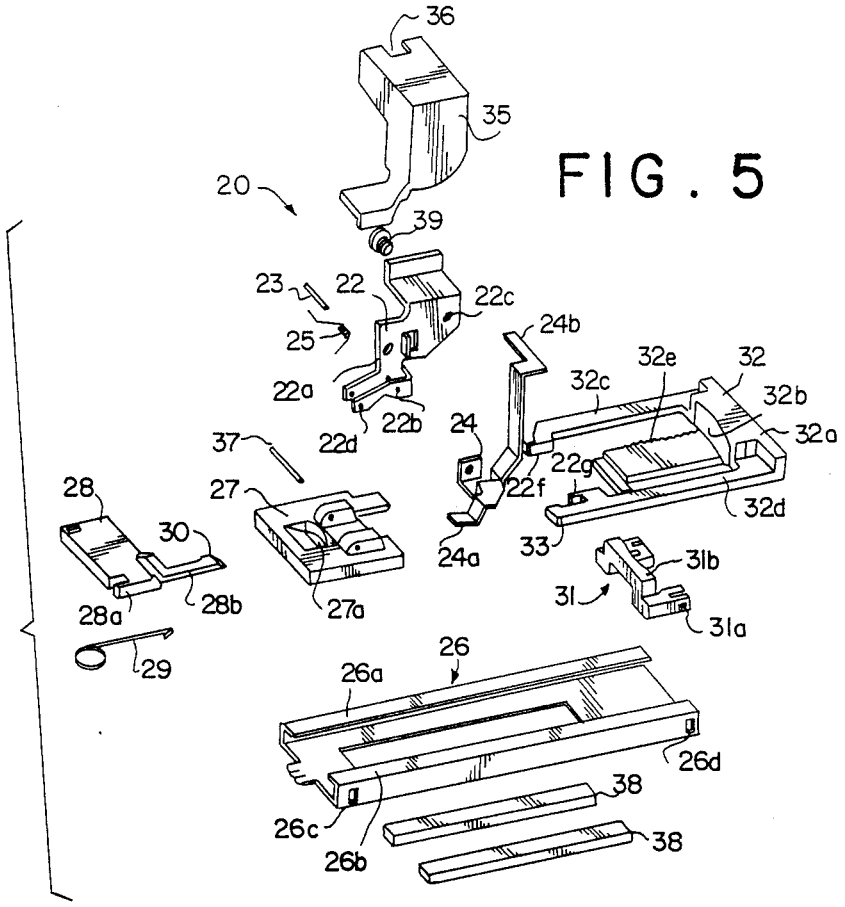
FIG. 5
FIG. 3
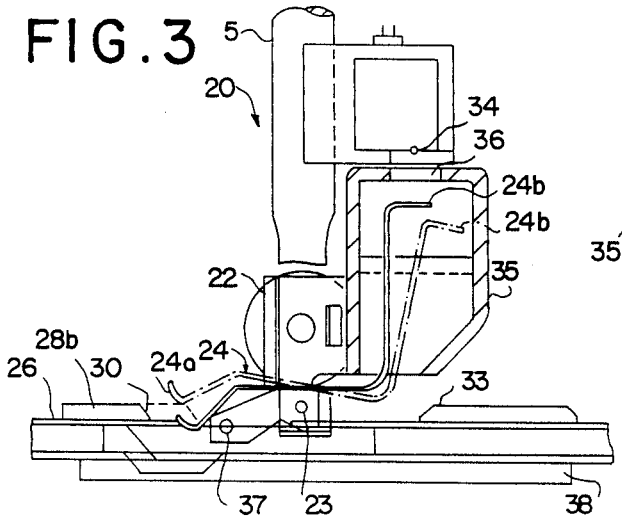
FIG. 4
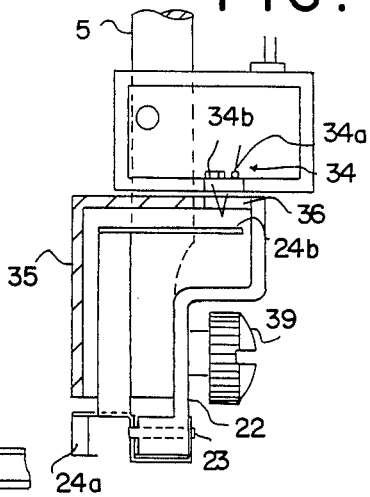

ELECTRONIC ZIGZAG SEWING MACHINE

FIELD OF THE INVENTION

This invention relates to an electronic zigzag sewing machine and more particularly to a buttonhole stitching device used in combination with an electronic zigzag sewing machine capable of switchably or optionally performing automatic stitching operation and manual stitching operation for producing buttonhole stitches on a workpiece.

BACKGROUND OF THE INVENTION

Buttonhole stitches may be automatically produced with the prior art electronic sewing machines in response to buttonhole stitch control data stored in a memory unit mounted in the sewing machine. The buttonhole stitches include in general darning stitches for reinforcing longitudinal ends of the buttonhole and first and second series of zigzag hem stitches at opposite sides of the buttonhole. The length or stitch number of the zigzag hem stitches should be adjusted in correspondence with a size or diameter with the concerned button.

For this purpose, there has been proposed to attach to a presser bar of the sewing machine a presser foot exclusively adapted to produce buttonhole stitches. According to such presser foot, it is possible to detect the longitudinal ends of zigzag hem stitches in correspondence with the concerned button, and the stitching operation can be automatically processed by sequentially reading out stitch control data for the darning stitches and zigzag hem stitches. What is to be done by the operator is simply to attach the said presser foot, select a desired one of the buttonhole stitches and operate the sewing machine as required for starting operation at a needle point to be first stitched on the workpiece for the buttonhole stitches.

With the said presser foot, it is possible to easily and automatically produce the buttonhole stitches. Applicability of the said presser foot would, however, be limited in actual sewing operation. More particularly, since the presser foot for automatic buttonhole stitching operation has a relatively wide sole area in contact with the workpiece, it has often failed to uniformly and sufficiently exert a downwardly directing pressure onto the workpiece, especially at its peripheral edge portions and in the corner, resulting in distorted and awkward appearance of the buttonhole stitches thus produced.

SUMMARY OF THE INVENTION

It is therefore an object of the invention to provide an electronic sewing machine capable of producing desired buttonhole stitches of a given length corresponding to a button size, even at an area close to peripheral edges of a workpiece and in the corner.

Another object of the invention is to provide means in an electronic sewing machine for switchably performing automatic and manual stitching operation to produce buttonhole stitches.

According to an aspect of the invention there is provided an electronic zigzag sewing machine comprising memory means for storing stitch control data for each stitch of a plurality of stitch patterns including one or more of buttonhole stitch patterns, said buttonhole stitch pattern being divided into plural parts to be sequentially produced in response to stitch control data assigned to each of said parts; select means for selecting a desired one of said stitch patterns; control means for reading out said stitch control data for a selected one of said stitch patterns, thereby controlling a needle amplitude and a fabric feeding amount; and signal generating means for generating a signal commanding a timing at which stitching operation of said buttonhole stitch pattern is to be proceeded from one part to the next part, said signal being supplied to said control means for reading out the stitch control data for the said next part of said buttonhole stitch pattern. The signal generating means comprises an automatic generating means for generating a first timing signal when sensor means mounted on a first presser foot automatically detects a final stitch of said one part of said buttonhole stitch pattern, and a manual generating means manually operated by an operator for generating a second timing signal when the operator visually detects said final stitch of said one part of said buttonhole stitch pattern, whereby said control means is operated to read out the stitch control data for the said next part of said buttonhole stitch pattern in response to any one of said first and second timing signals.

While producing the first part of the buttonhole stitches, the sewing machine will discriminate whether the buttonhole stitching operation should be processed in an automatic manner or in a manual manner. When the the first timing signal is generated from the automatic signal generating means in response to detection of a final stitch of the first part of the buttonhole stitches, the sewing machine becomes ready for processing the buttonhole stitching operation in the automatic manner, whereas when the operator manipulates the manual signal generating means during stitching of the first part to generate the second timing signal, further buttonhole stitching operation will be processed in the manual manner.

BRIEF DESCRIPTION OF THE ACCOMPANYING DRAWINGS

These and other objects of the invention as well as characteristic features thereof will be fully understood from the following detailed description when read in conjunction with the accompanying drawings in which;

FIGS. 3 and 4 are side and front views, on an enlarged scale, partly in section, showing essential parts of the presser foot;

FIG. 5 is an exploded perspective view, on an enlarged scale, showing the presser foot;

Figure 7A:
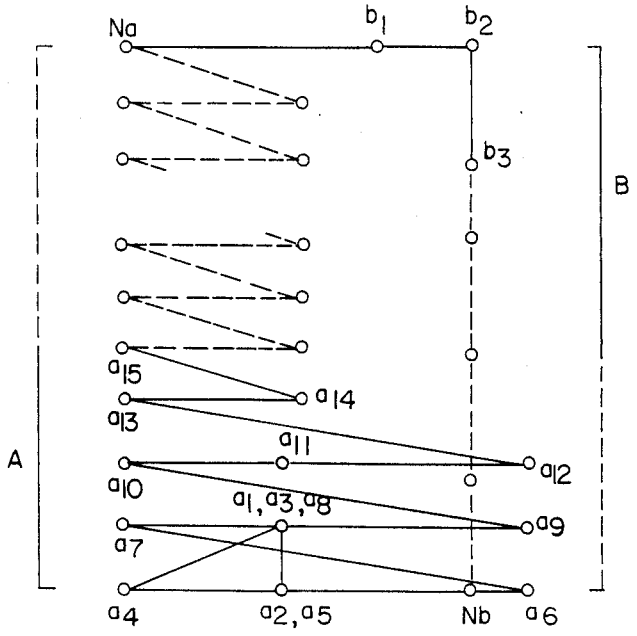
Figure 7B:
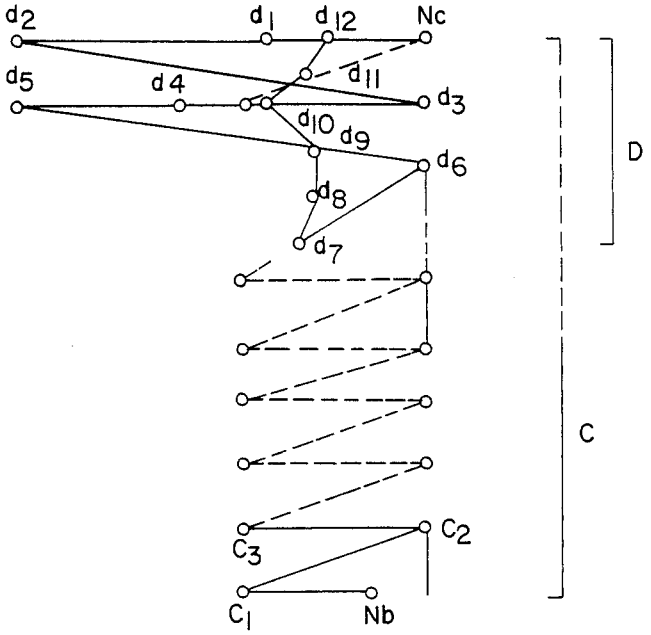
Figure 8A:
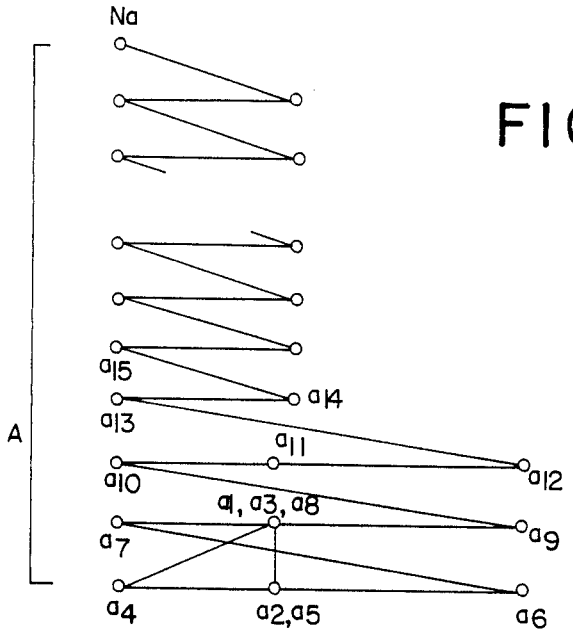
Figure 8B:
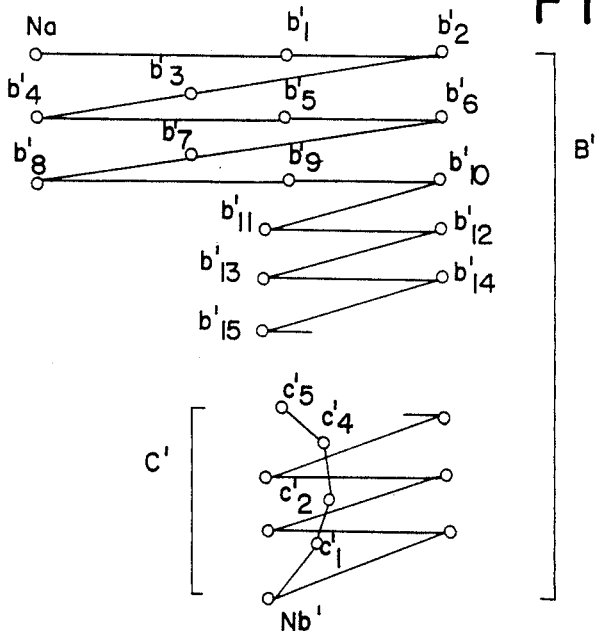

FIGS. 7(*a*) and 7(*b*) are explanatory views showing the manner in which one example of the buttonhole stitch patterns are automatically produced with the sewing machine to which the presser foot shown in FIGS. 2 to 5 is attached; and FIGS. 8(*a*) and 8(*b*) are explanatory views showing the manner in which the similar buttonhole stitch patterns are produced in a manual manner.

DESCRIPTION OF EMBODIMENTS

Figure 1:
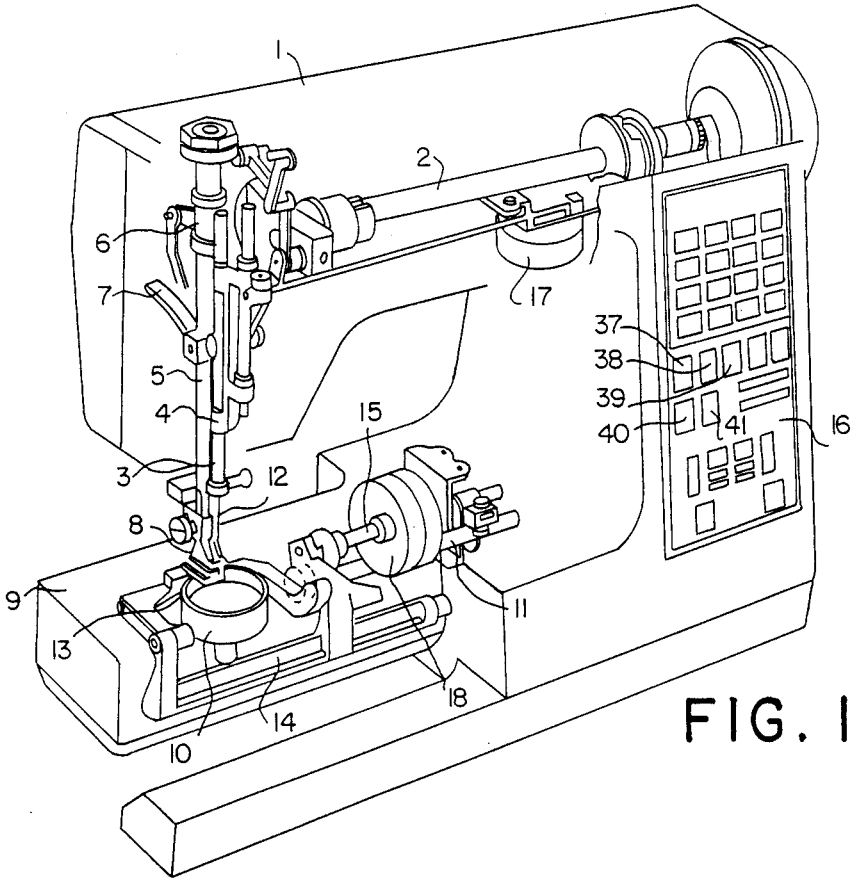
FIG. 1 is a schematic perspective view showing an electronic sewing machine embodying the invention.
Figure 2:
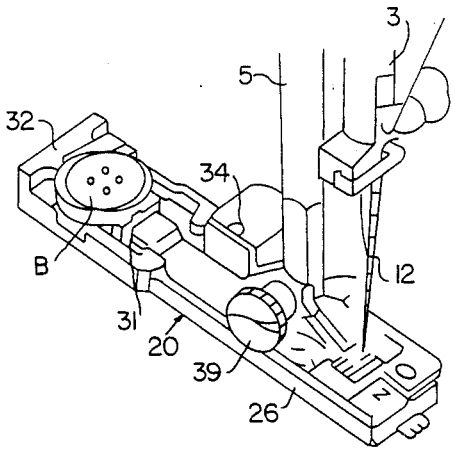
FIG. 2 is a perspective view showing a presser foot for automatic buttonhole stitching operation which is in actual use with the sewing machine.

As illustrated in FIG. 1, an electronic sewing machine embodying the invention includes a housing or arm 1 in which an upper drive shaft 2 is rotatably mounted. At a projecting end of the arm 1 there is provided a vertically extending, laterally swingable support member 4 by which a needle bar 3 carrying a needle 12 at the bottom is supported but allowed to reciprocate up and down in synchronism as a result of the rotation of the upper drive shaft 2. A presser bar 5 is also supported by the support member 4. To the lower end of the presser bar 5 is detachably mounted a presser foot 8 which is adapted to produce buttonhole stitches on a workpiece in a manual manner to be described later. The presser bar 5 is normally biased downwardly by a spring 6 to exert a pressure onto the workpiece placed between the presser foot and a table 9, but said pressure may be released by operating a lever 7.

In a hollow space of the workpiece table 9 is rotatably supported a horizontal loop-taker 10 which is rotated with a lower drive shaft 11 in synchronism with rotation of the upper shaft 2 so that a thread loop hook portion (not exactly shown) of the loop-taker 10 cooperates with the needle 12 to form a stitch composed of upper and lower threads as is well known in the conventional stitching operation. The workpiece can be shifted above the table 9 by means of a feed dog driven in four directions with rotating shafts 14 and 15. A stepping motor 17 for controlling a needle amplitude and another stepping motor 18 for controlling a workpiece feeding amount are both mounted within the machine housing 2.

The machine housing 2 has a keyboard panel 16 on which are arranged a number of operating keys or switch buttons. Operation of these keys as required will read out stitch control data from a memory unit mounted in the machine housing 2 to produce a desired stitch pattern. Stitch pattern selecting keys include several keys for selecting some different kinds or shapes of buttonhole stitches, for example, a key for bar tack buttonhole stitches 37, a key for round buttonhole stitches 38 and a key for key hole buttonhole stitches 39. There are also arranged a memory key 40 which has a material function in stitching buttonhole stitch patterns in a manual manner as described later, and a function key 41 for reducing or enlarging the size of the selected stitch pattern as required. The keyboard panel 16 is also provided with a needle amplitude control key for actuating the first stepping motor 17 and a workpiece feeding amount control key for actuating the second stepping motor 18. The read-out stitch pattern is represented on a display for confirmation purposes.

The presser foot 8, shown in FIG. 1, for manual buttonhole stitching operation can be replaced by another one for automatic buttonhole stitching operation. One example of the presser foot 20 for automatic buttonhole stitching operation is illustrated in FIGS. 2 to 5. The presser foot 20 is, in use, attached to the lower end of the presser bar 5. The Removal or replacement of the presser foot 8, 20 can easily be done through a fastening screw 39. A switch lever 24 having at its one end a dog-leg contact face 24*a* and at the other end a laterally extending arm 24*b* of a gloss, is pivotably connected to a supporting frame 22 by means of a pivot axis 23. A spring 25 is wound around the pivot axis 23 to bias the switch lever 24 to normally rotate in the counter-clockwise direction as viewed in FIGS. 3 and 5. To the leading end of the support frame 22 is rotatably connected to slider 27 by means of a pin 22*a*. The slider 27 are grasped by oppositely raised and inwardly directing walls 26*a* of a workpiece presser sole 26 to allow relative displacement between the slider 27 and the presser sole 26 in the normal feeding direction. A pair of guide pads 26*b* of material such as rubber having a relatively great coefficient of friction are attached to the presser sole 26. Thus, the presser sole 26 is moved together with the workpiece which is, in turn, fed by the feed dog 13.

Adjacent to both ends of the opposing raised wall sections 26*a* of the presser sole 26 are respectively formed a pair of apertures 26*c*, 26*c* and 26*d*, 26*d*, though only a respective one of each is shown in FIG. 5. A piece 28 is received within the presser sole 26 at one end thereof and secured thereat through engagement between the apertures 26*c* and projections 28*a* of the piece 28. The piece 28 includes a rightward projecting portion 28*b* having a tapered face 30 at its leading end. A spring 29 is connected between the piece 28 and the slider 27 to normally bias the latter to pull toward the former. On the contrary, a first button engaging member 31 is secured at the opposite end to the presser sole 26 through engagement between the apertures 26*d* and projections 31*a* of the first button engaging member 31. A second button engaging member 32 is slideably supported by the presser sole 26, with a centrally projecting base portion 32*a* being received within the hollow space between the walls 26*a* and opposite projecting arms 32*b* and 32*c* adapted to be in contact with the upper horizontal section of the walls 26*a*. The leading end of one arm 32*d* of the arms is shaped into a tapered face 33 which is located in opposition to the tapered face 30. An arcuate inner wall 32*b* of the second button engaging member 32 is cooperated with another arcuate inner wall 31*b* of the first button engaging member 31 to accomodate therebetween a button of a given size or diameter. A distance between the opposing two tapered faces 30 and 33 is determined somewhat larger than a distance between the two arcuate walls 31*b* and 32*d*, which may be adjusted by sliding the second button engaging member 32 with respect to the first member 31 in correspondence with the diameter of the button B held therebetween.

The switch lever 24 is housed in a cover 35 provided at the upper face with a cut-out or opening 36. With the cover 35 secured to the presser bar 5 by the fastening screw 39, the opening 36 is positioned just above the upper gloss reflector 24*b* when the switch lever 24 is biased by the spring 25 to occupy its normal position. Above the cover is mounted a reflective photosensor 34 comprising a light emitting diode or the like element 34*a* emitting light downwardly through the opening 36 toward the gloss reflector 24*b* and a light receiving element adapted to receive the reflection from the gloss 24*b*. To prevent ambient light from projecting toward the gloss reflector 34*b*, the cover 35 and the supporting frame 22 are painted mat black.

Figure 6:
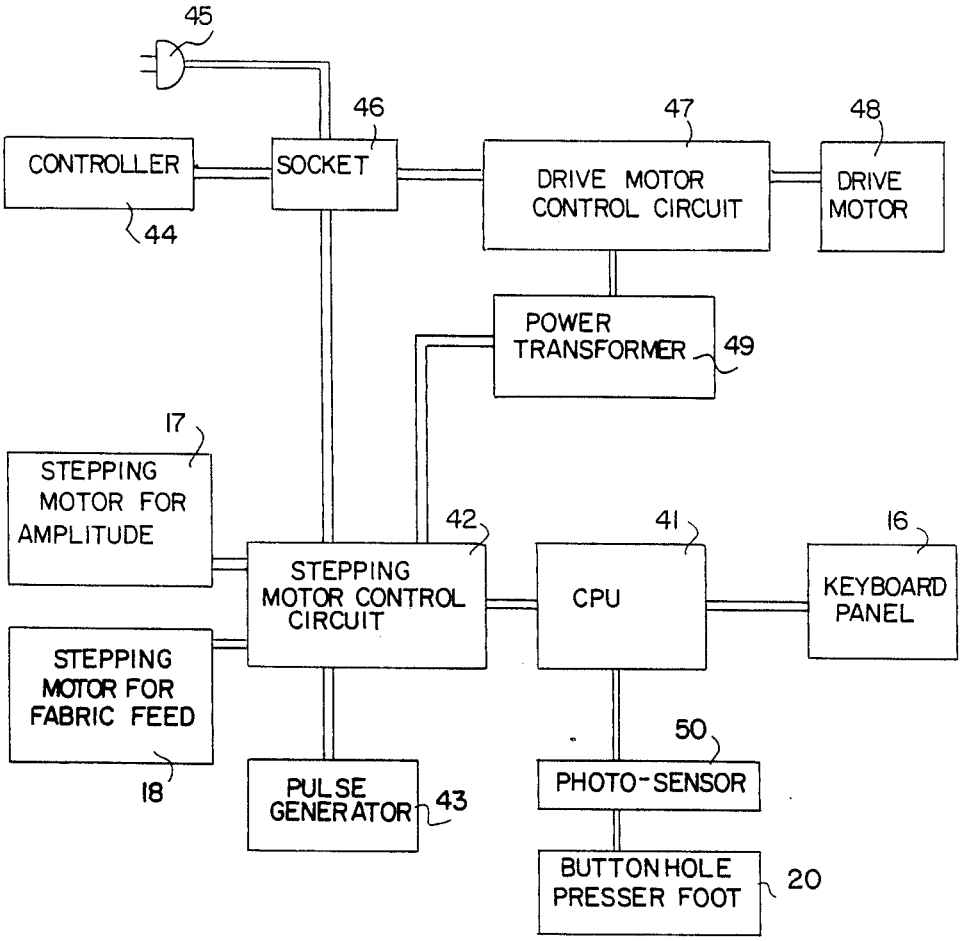
FIG. 6 is a block diagram showing the electric arrangements of the sewing machine.

The electronic sewing machine has an electric arrangement as shown in FIG. 6. The stitch control data for the respective stitch patterns are stored in a memory unit of CPU 41, which will read out specific stitch control data in response to operation of a corresponding stitch pattern select key arranged on the keyboard panel 16. The stepping motors 17 and 18 are driven in response to the data supplied from CPU 41, under control of a stepping motor control circuit 42, each time a pulse generates from a generator 43 at a specific phase or position of the upper drive shaft 2, thereby controlling amplitude of the sewing needle and the workpiece feeding amount in each stitch. A controller 44 and an electric power supply plug 45 are detachably connected to a socket 46 which is in turn connected to the sewing machine. By manual operation of the controller 44, a drive motor 48 is energized for starting the sewing machine operation via a driving motor control circuit 47 and a power transformer 49, and a revolution of the drive motor 48 is adjusted for controlling the stitching speed. CPU 41 is cooperated with the afore-mentioned photo-sensor means 50 mounted on the presser foot 19 so that during the automatic buttonhole stitching operation with the presser foot 20, the stitch control data is sequentially read out to proceed to the next stitch pattern in a manner described later in detail. According to this invention, CPU 41 is provided with means for discriminating if buttonhole stitches are to be produced in an automatic processing manner or in a manual processing manner.

Provided a buttonhole for a button B is to be automatically stitched on the workpiece with the electronic sewing machine. In this case, the presser foot 20 shown in FIGS. 2 to 5 is attached to the presser bar 5, and the button B is actually placed on the longitudinally extending platform **32*a* of the second button engaging member 32. Then, the second button engaging member 32 is shifted along the inwardly directing walls 26*a* of the workpiece presser 26 until the arcuate wall 32*d* is cooperated with the first arcuate wall 31*b* to hold in position and clamp the button B therebetween. Thus, the two tapered faces 30 and 33 are separated from each other, providing a distance therebetween which is automatically determined by the size or diameter of the button B and which is, in turn, determinant of a length of the line tack portion of the buttonhole to be stitched. Then, the workpiece presser 26 is moved to the right so that the lower end 24*a* of the switch lever 24 is caused to run aground on the first tapered face 30. At this time, the switch lever 24 has been slightly rotated in the clockwise direction against the biasing force of the spring 25 and therefore is positioned in its inoperative position shown by an imaginary line in FIG. 3, thereby intercepting the reflection from the gloss reflector 24*b* toward the receiving element 34*c***.

Then, the controller 44 is operated to start the sewing machine. In response to manual operation of a selected one of the buttonhole stitch pattern selecting keys 37, 38 and 39, CPU 41 will read out the corresponding buttonhole stitch data from the memory unit to drive under control the amplitude control stepping motor 17 and the workpiece feed control stepping motor 18, thereby controlling a zigzag stitch amplitude and a workpiece feeding amount for each stitch of the buttonhole stitches.

The buttonhole stitch pattern to be produced in the automatic manner with the presser foot 20 is diagramatically illustrated in FIGS. 7(*a*) and 7(*b*), by way of example. This buttonhole stitch pattern will be sequentially produced in four steps. The stitches in the first step A consist of lower end bar tacks of a predetermined number of stitches for reinforcing one longitudinal end of the buttonhole, which are produced by successively dropping the needle 12 at points $a_1$ to $a_{12}$, followed by a first series of line tacks to be located at one (left) side of the buttonhole, which are produced from successive needle dropping points of $a_{13}$, $a_{14}$, $a_{15}$ - - and ends at a point Na. The bar tacks are stitched with substantially the maximum needle amplitude but with little workpiece feeding amount, while the line tacks are stitched with substantially a half the maximum needle amplitude while the workpiece is being fed in the backward direction by a given fabric feeding amount each stitch but one. A first pattern number of the buttonhole stitches is assigned to stitching of the part A. Definite stitch control data will be given to all of the bar tack portion consisting of the points $a_1$ to $a_{12}$ and to only the first three points $a_{13}$ to $a_{15}$ in the line tack portion. Succeeding stitches in the line tack portion can be produced in response to stitch control data commanding that the similar line tacks be repeatedly produced with the same needle amplitude and with the same workpiece feeding amount, until one longitudinal end of the buttonhole is detected with the presser foot 20, at point Na. Thus, the timing signal commanding that the stitching operation be proceeded to the next part B in response to the stitch control data therefor is sent to CPU 41. The second part B will be stitched by designating a second pattern number included next in the same buttonhole stitches. The second part B is produced from the point Na and consists of lateral straight stitches made by points $b_1$ and $b_2$ and longitudinal straight stitches made by feeding the workpiece in the opposite direction to drop the needle at points $b_3$ - - . The stitching operation of the second part B is finished at point Nb, which can likewise be found by detecting the other longitudinal end of the buttonhole 20 with the presser foot 20. Then, the buttonhole stitching operation proceeds to the third step C in which a second series of line tacks at the other side of the buttonhole will be produced in the like manner as in the first series of line tacks. The third part C is produced by designating a third pattern number included next in the same buttonhole stitches, which includes definite stitch control data for the stitches $c_1$ to $c_3$, succeeding stitches being produced by stitch control data commanding the repeated operation of the line tacks. A finishing point Nc of the third part C can be found by the presser foot or sensor 20. The fourth part D includes a predetermined number of stitches comprising end stitches made by points $d_1$ to $d_{12}$ in the like manner as in the lower end bar tacks. Each needle dropping point $d_1$ to $d_{12}$ constituting the fourth part D will be produced in accordance with definite stitch control data stored with respect to a fourth pattern number included next in the same buttonhole stitches. The buttonhole stitches will thus be completed by successively producing the parts A to D. The first to fourth pattern numbers assigned for producing the first to fourth parts A to D respectively are stored in the memory unit of CPU 41 in connection with the selected buttonhole stitch pattern and can be read out step by step from the memory unit. Although not shown, the buttonhole stitches may further include an additional, fifth part for returning the needle 12 to a starting position ready to repeat the buttonhole stitching operation for the same buttonhole as from the step A.

As above described, the presser foot 20 may be used as a buttonhole sensor 50 for detecting the longitudinal ends of the buttonhole. When the first pattern A proceeds to the final stitch (Na) of the line tacks, at which time the contact face **24*a* is run aground on the second tapered face 33 so that the switch lever 24 is turned to its inoperative position, the light emitted from the diode 34*a* is not reflected toward the other element 34*b*. In response to such detection, CPU 41 is so operated to renew the pattern number, and in other words, to read out the next, second pattern number so that stitching operation proceeds to the second part B starting at point Na. Likewise, the needle dropping points Nb and Nc at which the stitching operation should proceed to the next step, can be detected by the sensor means 50 or presser foot 20**.

It is often desired to produce the buttonhole stitches on a workpiece in the close vicinity of peripheral edge portions thereof or in the corner. The sewing machine embodying the invention is adapted to produce the similar buttonhole stitch pattern as in FIGS. 7(*a*) and 7(*b*), in a manual manner. Because the presser foot 20 having a relatively wide sole area could not effectively be employed in this case, this presser foot 20 is detached from the presser bar 5 by loosening the screw 39 and replaced by the presser foot 8 for use in manual buttonhole stitching operation by again fastening the screw 39. Then, a selective one of the buttonhole stitch pattern selecting keys 37, 38 and 39 is operated, followed by operation of the controller 44, so that the first pattern number is read out from the memory unit of CPU 41 to start stitching the part A in response to the stitch control data provided in the first pattern number. During the stitching operation in the first part A, the operator should carefully watch the situation so that the memory key 40 is manipulated, without delay, when the needle 12 comes to the one longitudinal end point Na, otherwise the line tacks would be produced endlessly. Responsive to a signal generated by operation of the memory key 40, CPU 41 will discriminate that the selected buttonhole stitches are now being produced and should further be produced in the manual manner, and command immediately thereafter that the pattern number be renewed to the next and the second step B' be now started from point Na. In the part B', a second series of the line tacks on the opposite side of the buttonhole will be produced by dropping the needle at points $b'_1$, $b'_2$, - - and Nb' while the workpiece is being fed in the opposite direction. The step-up commanding signal from the second part B' to the third part C' at Nb is likewise generated by manipuling the memory key 40 in a timely fashion. Thus, the procedure steps up to the third step C' wherein the end stitches comprising points $c'_1$ to $c'_5$ are sequentially formed.

With the afore-mentioned sewing machine according to the invention, a step-up timing for renewing one pattern number to the next in the buttonhole stitch pattern is determined responsive to a command signal, which is automatically generated in response to detection of the longitudinal end of the buttonhole by means of the presser foot 20 in the case of automatic buttonhole stitching operation, whereas in the case of manual buttonhole stitching operation which is generated by manipulating the specific key by the operator himself. Therefore, where the buttonhole specially adapted for automatic buttonhole stitching operation is difficult to use, or particularly where the buttonhole stitches are to be produced in an area close to the peripheral edge portion or the corner of the workpiece, shapely buttonhole stitches can easily be produced merely by employing another presser foot adapted to be used for manual buttonhole stitching operation and by manually operating the specific key. The sewing machine is capable of discriminating whether the buttonhole stitches be produced in an automatic processing manner or in a manual processing manner, responsive to a first timing signal generated by the sensor means when detecting the longitudinal end of the buttonhole or a second timing signal generated by manual key operation. Either the first or second timing signal is generated during stitching the first part of the buttonhole stitches.

While the invention has been described in conjunction with a specific embodiment thereof, it should be understood that this invention is not limited to the illustrated embodiment and many variations and modifications may be made without departing from the spirit and scope of the invention as defined in the appended claims. For example, in the illustrated embodiment, the stitch control data stored in the memory unit for the same buttonhole stitch pattern are classified into two different data, one for automatic buttonhole stitching operation and the other for manual buttonhole stitching operation, though both including identical data in connection with the first part A. One of the two is selectively read out in response to the first or second timing signal generated during stitching of the identical part A. However, the automatic and manual operation can proceed completely in the same manner, responsive to the identical stitch control data. In this case, the first and second timing signal will govern the timing at which the stitching operation should proceed to the next step but provide no means for discriminating whether the buttonhole stitches are being produced in automatic or manual manner.

What we claim is:

1. An improved electronic zigzag sewing machine comprising memory means for storing stitch control data for each stitch of a plurality of stitch patterns including one or more of buttonhole stitch pattern, said buttonhole stitch pattern being divided into plural parts to be sequentially produced in response to stitch control data assigned to each of said parts; selecting means for selecting a desired one of said stitch patterns; control means for reading out said stitch control data for a selected one of said stitch patterns, thereby controlling a needle amplitude and a fabric feeding amount; and signal generating means for generating a signal commanding a timing at which stitching operation of said buttonhole stitch pattern is to proceed from one part to the next part, said signal being supplied to said control means for reading out the stitch control data for the said next part of said buttonhole stitch pattern; the improvement wherein said signal generating means comprises an automatic generating means for generating a first timing signal when sensor means mounted on a first presser foot automatically detects a final stitch of said one part of said buttonhole stitch pattern, and a manual generating means manually operated by an operator for generating a second timing signal when the operator visually detects said final stitch of said one part of said buttonhole stitch pattern, said control means being operated to read out the stitch control data for the said next part of said buttonhole stitch pattern in response to any one of said first and second timing signals.

2. The electronic zigzag sewing machine according to claim 1, wherein said manual signal generating means comprises a key arranged on a machine housing.

3. The electronic zigzag sewing machine according to claim 1, wherein said buttonhole stitch pattern is produced in an automatic processing manner in response to a first series of the stitch control data or in a manual processing manner in response to a second series of the stitch control data, said first and second series of the stitch control data being both stored in said memory means for the same buttonhole stitch pattern and including identical stitch control data for a first part of the buttonhole stitch pattern, and said control means is operated in response to one of said first and second timing signal which is generated during stitching in the first part of the buttonhole stitch pattern, to detect whether further stitching operation should be carried out in the automatic or manual processing manner, whereupon a corresponding one of the first and second series of the stitch control data can be read out from said memory means.

* * * * *

UNITED STATES PATENT AND TRADEMARK OFFICE

CERTIFICATE OF CORRECTION

PATENT NO. : 4,953,486

DATED : September 4, 1990

INVENTOR(S) : Yasuro Sano, Akira Orii and Eiji Murakami (Case Sano et al)

It is certified that error appears in the above-identified patent and that said Letters Patent is hereby corrected as shown below:

ON TITLE PAGE: column 1, immediately preceding item [21], insert the following item containing the Assignee's name: —[73] Assignee: Janome Sewing Machine Co., Ltd., Tokyo, Japan—.

Signed and Sealed this

Twenty-seventh Day of August, 1991

*Attest:*

*Attesting Officer*

HARRY F. MANBECK, JR.

*Commissioner of Patents and Trademarks*